US010253636B2

(12) United States Patent
Devore et al.

(10) Patent No.: US 10,253,636 B2
(45) Date of Patent: Apr. 9, 2019

(54) FLOW EXCHANGE BAFFLE INSERT FOR A GAS TURBINE ENGINE COMPONENT

(71) Applicant: United Technologies Corporation, Farmington, CT (US)

(72) Inventors: Matthew A. Devore, Rocky Hill, CT (US); Eleanor D. Kaufman, Rocky Hill, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 514 days.

(21) Appl. No.: 14/997,992

(22) Filed: Jan. 18, 2016

(65) Prior Publication Data

US 2017/0204731 A1 Jul. 20, 2017

(51) Int. Cl.

| | |
|---|---|
| ***F01D 5/18*** | (2006.01) |
| ***F01D 25/12*** | (2006.01) |
| ***F01D 9/02*** | (2006.01) |
| ***F01D 9/06*** | (2006.01) |

(52) U.S. Cl.

CPC ..... *F01D 5/189* (2013.01); *F01D 9/02* (2013.01); *F01D 9/065* (2013.01); *F01D 25/12* (2013.01); *F05D 2220/32* (2013.01); *F05D 2260/2212* (2013.01)

(58) Field of Classification Search

CPC ..... F01D 5/187–5/189

See application file for complete search history.

(56) References Cited

U.S. PATENT DOCUMENTS

| | | | | |
|---|---|---|---|---|
| 3,540,810 | A * | 11/1970 | Kercher | F01D 5/189 415/115 |
| 4,025,226 | A | 5/1977 | Hovan | |
| 4,288,201 | A * | 9/1981 | Wilson | F01D 5/189 415/115 |
| 4,798,515 | A * | 1/1989 | Hsia | F01D 5/18 415/115 |
| 5,120,192 | A * | 6/1992 | Ohtomo | F01D 5/189 415/115 |
| 5,464,322 | A | 11/1995 | Cunha et al. | |
| 6,905,301 | B2 * | 6/2005 | Tiemann | F01D 5/189 415/115 |
| 7,104,756 | B2 * | 9/2006 | Harding | F01D 5/189 416/233 |

(Continued)

FOREIGN PATENT DOCUMENTS

WO 2015023338 A2 2/2015

OTHER PUBLICATIONS

European Search Report for Application No. EP 17 15 1466.

*Primary Examiner* — Jason D Shanske
*Assistant Examiner* — Brian O Peters
(74) *Attorney, Agent, or Firm* — Cantor Colburn LLP

(57) ABSTRACT

A baffle insert for a component of a gas turbine engine is provided. The baffle insert having: a first fluid conduit having a first interior cavity extending therethrough; a second fluid conduit having a second interior cavity extending therethrough; and a member located between the first fluid conduit and the second fluid conduit, wherein the member fluidly couples the first interior cavity to an exterior of the second fluid conduit, and wherein the member fluidly couples the second interior cavity to an exterior of the first fluid conduit and wherein the first interior cavity is isolated from the second interior cavity.

20 Claims, 5 Drawing Sheets

(56) References Cited

U.S. PATENT DOCUMENTS

| | | | | |
|---|---|---|---|---|
| 8,864,438 | B1 | 10/2014 | Lee et al. | |
| 9,435,212 | B2 * | 9/2016 | Scribner | F01D 5/188 |
| 2010/0054915 | A1 | 3/2010 | Devore et al. | |
| 2014/0075947 | A1 | 3/2014 | Gautschi et al. | |
| 2015/0226085 | A1 | 8/2015 | Spangler et al. | |
| 2015/0285096 | A1 * | 10/2015 | Spangler | F01D 9/02 415/115 |

* cited by examiner

FLOW EXCHANGE BAFFLE INSERT FOR A GAS TURBINE ENGINE COMPONENT

BACKGROUND

This disclosure relates generally to gas turbine engines and, more particularly, to cooling techniques for the airfoil sections of turbine blades and/or vanes of the engine. In particular, the present application is directed to an insert for use in convective cooling of the airfoils of the gas turbine engine which are exposed to high-temperature working fluid flow.

In general, gas turbine engines are built around a power core comprising a compressor, a combustor and a turbine, which are arranged in flow series with a forward (upstream) inlet and an aft (downstream) exhaust. The compressor compresses air from the inlet, which is mixed with fuel in the combustor and ignited to produce hot combustion gases. The hot combustion gases drive the turbine section, and are exhausted with the downstream flow.

The turbine drives the compressor via a shaft or a series of coaxially nested shaft spools, each driven at different pressures and speeds. The spools employ a number of stages comprised of alternating rotor blades and stator vanes. The vanes and blades typically have airfoil cross sections, in order to facilitate compression of the incoming air and extraction of rotational energy in the turbine.

High combustion temperatures also increase thermal and mechanical loads, particularly on turbine airfoils downstream of the combustor. This reduces service life and reliability, and increases operational costs associated with maintenance and repairs.

Accordingly, it is desirable to provide cooling to the airfoils of the engine.

BRIEF DESCRIPTION

In one embodiment, a baffle insert for a component of a gas turbine engine is provided. The baffle insert having: a first fluid conduit having a first interior cavity extending therethrough; a second fluid conduit having a second interior cavity extending therethrough; and a member located between the first fluid conduit and the second fluid conduit, wherein the member fluidly couples the first interior cavity to an exterior of the second fluid conduit, and wherein the member fluidly couples the second interior cavity to an exterior of the first fluid conduit and wherein the first interior cavity is isolated from the second interior cavity.

In addition to one or more of the features described above, or as an alternative to any of the foregoing embodiments, the first fluid conduit may be aligned with the second fluid conduit and the first fluid conduit is located above the second fluid conduit.

In addition to one or more of the features described above, or as an alternative to any of the foregoing embodiments, the member may be configured to have a peripheral dimension that is greater than a peripheral dimension of the first fluid conduit and a peripheral dimension of the second fluid conduit.

In addition to one or more of the features described above, or as an alternative to any of the foregoing embodiments, the first fluid conduit may have a first configuration and the second fluid conduit may have a second configuration, wherein the first configuration is similar to the second configuration.

In addition to one or more of the features described above, or as an alternative to any of the foregoing embodiments, the member may be configured to have a peripheral dimension that is greater than a peripheral dimension of the first fluid conduit and a peripheral dimension of the second fluid conduit.

In addition to one or more of the features described above, or as an alternative to any of the foregoing embodiments, the first fluid conduit may have a peripheral dimension that is less than a peripheral dimension of the second fluid conduit.

In addition to one or more of the features described above, or as an alternative to any of the foregoing embodiments, the member may be configured to have a peripheral dimension that is greater than a peripheral dimension of the first fluid conduit and a peripheral dimension of the second fluid conduit.

In addition to one or more of the features described above, or as an alternative to any of the foregoing embodiments, the first fluid conduit may be aligned with the second fluid conduit and the first fluid conduit is located above the second fluid conduit.

In yet another embodiment, a component for a gas turbine engine is provided, the component having: an internal cooling cavity extending through an interior of the component; and a baffle insert configured to be inserted into the internal cooling cavity, the baffle insert comprising: a first fluid conduit having a first interior cavity extending therethrough; a second fluid conduit having a second interior cavity extending therethrough; and a member located between the first fluid conduit and the second fluid conduit, wherein the member fluidly couples the first interior cavity to an exterior of the second fluid conduit, and wherein the member fluidly couples the second interior cavity to an exterior of the first fluid conduit and wherein the first interior cavity is isolated from the second interior cavity.

In addition to one or more of the features described above, or as an alternative to any of the foregoing embodiments, the first fluid conduit may be aligned with the second fluid conduit and the first fluid conduit may be located above the second fluid conduit.

In addition to one or more of the features described above, or as an alternative to any of the foregoing embodiments, the member may be configured to have a peripheral dimension that is greater than a peripheral dimension of the first fluid conduit and a peripheral dimension of the second fluid conduit.

In addition to one or more of the features described above, or as an alternative to any of the foregoing embodiments, the first fluid conduit may have a first configuration and the second fluid conduit may have a second configuration, wherein the first configuration is similar to the second configuration.

In addition to one or more of the features described above, or as an alternative to any of the foregoing embodiments, the member may be configured to have a peripheral dimension that is greater than a peripheral dimension of the first fluid conduit and a peripheral dimension of the second fluid conduit.

In addition to one or more of the features described above, or as an alternative to any of the foregoing embodiments, the first fluid conduit may have a peripheral dimension that is less than a peripheral dimension of the second fluid conduit.

In addition to one or more of the features described above, or as an alternative to any of the foregoing embodiments, the member may be configured to have a peripheral dimension that is greater than a peripheral dimension of the first fluid conduit and a peripheral dimension of the second fluid conduit.

In addition to one or more of the features described above, or as an alternative to any of the foregoing embodiments, the first fluid conduit may be aligned with the second fluid conduit and the first fluid conduit is located above the second fluid conduit and wherein the member has a plurality of openings extending therethrough for fluidly coupling the first interior cavity to the exterior of the second fluid conduit, and fluidly coupling the second interior cavity to the exterior of the first fluid conduit.

In addition to one or more of the features described above, or as an alternative to any of the foregoing embodiments, the component may be an airfoil of either a vane or a rotating blade of a gas turbine engine.

In yet another embodiment, a method of exchanging a cooling flow through a component of a gas turbine engine is provided. The method including the steps of: directing a first flow of a cooling fluid through a baffle insert located in an internal cooling cavity extending through an interior of the component; directing a second flow of the cooling fluid through the baffle insert, wherein the first flow of the cooling fluid passes through a first fluid conduit having a first interior cavity extending therethrough and the second flow of the cooling fluid passes through a second fluid conduit having a second interior cavity extending therethrough, wherein the first flow of cooling fluid is surrounded by the second flow of cooling fluid when the first flow of cooling fluid is located in the first interior cavity such that the first flow of cooling fluid is thermally insulated by the second flow of cooling fluid; and exchanging the locations of the first flow of the cooling fluid with respect to the second flow of the cooling fluid by passing the first flow of the cooling fluid and the second flow of the cooling fluid through a member located between the first fluid conduit and the second fluid conduit, wherein the member fluidly couples the first interior cavity to an exterior of the second fluid conduit, and wherein the member fluidly couples the second interior cavity to an exterior of the first fluid conduit and wherein the second flow of cooling fluid is surrounded by the first flow of cooling fluid when the second flow of cooling fluid is located in the second interior cavity such that the second flow of cooling fluid is thermally insulated by the first flow of cooling fluid.

In addition to one or more of the features described above, or as an alternative to any of the foregoing embodiments, the first fluid conduit may be aligned with the second fluid conduit and is located above the second fluid conduit.

In addition to one or more of the features described above, or as an alternative to any of the foregoing embodiments, the component may be an airfoil of either a vane or a rotating blade of a gas turbine engine.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Various embodiments of the present disclosure are related to cooling techniques for airfoil sections of gas turbine components such as vanes or blades of the engine. In particular, the present application is directed to an insert or baffle or baffle insert used in conjunction with cooling passages of the airfoil.

Figure 1:
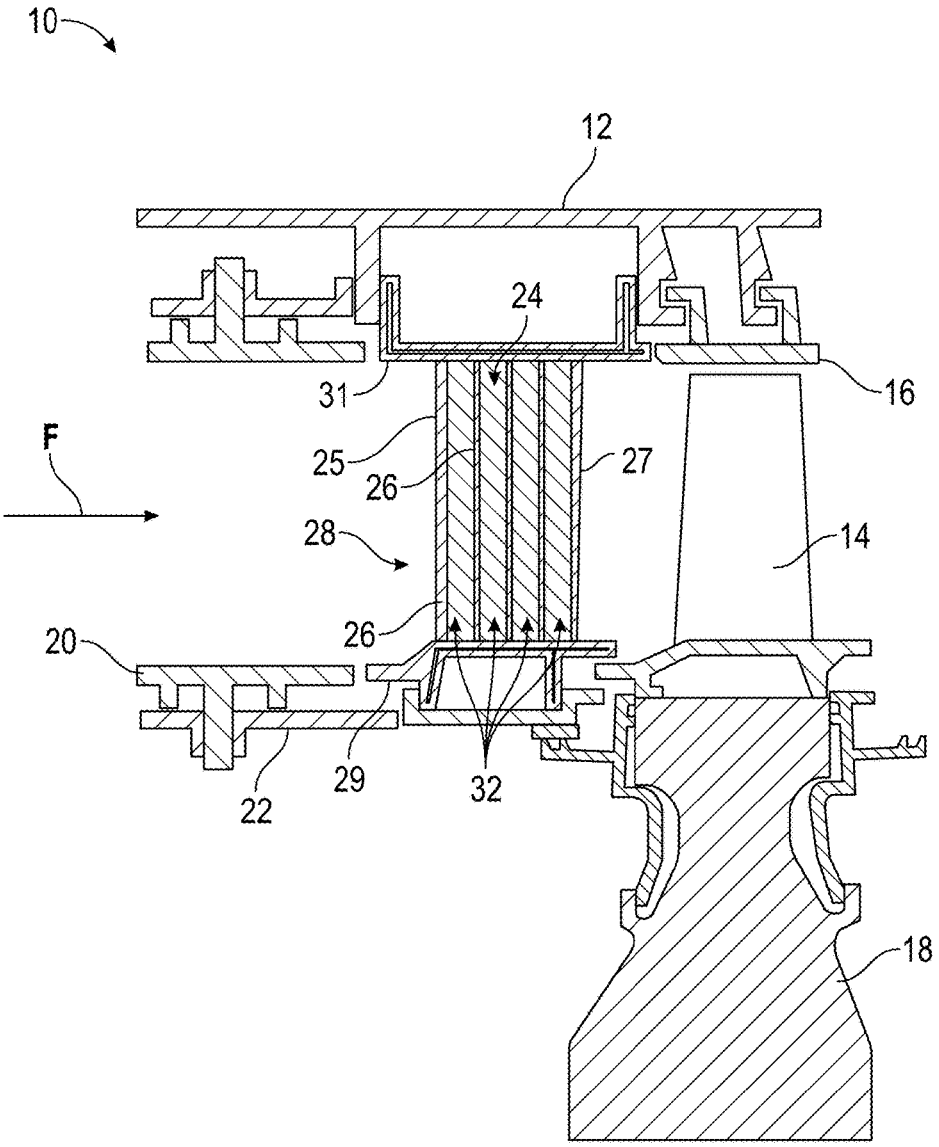
FIG. 1 is a cross-sectional view of a portion of a gas turbine engine.
Figure 2:
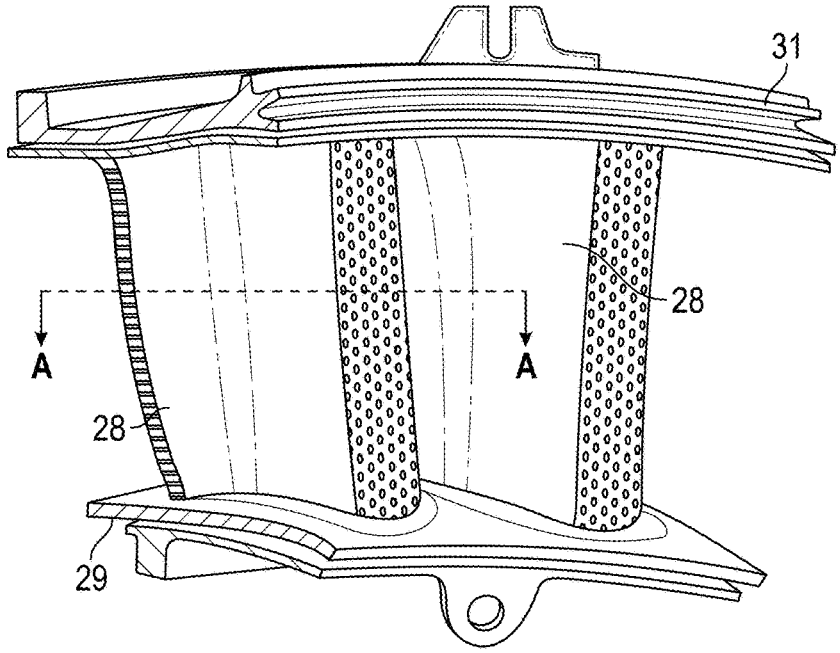
FIG. 2 is a perspective view of a pair of vanes of a gas turbine engine.

FIG. 1 is a cross-sectional view of a portion of a gas turbine engine 10 wherein various components of the engine 10 are illustrated. These components include but are not limited to an engine case 12, a rotor blade 14, a blade outer air seal (BOAS) 16, a rotor disk 18, a combustor panel 20, a combustor liner 22 and a vane 24. As mentioned above, vane or component 24 is subjected to high thermal loads due to it being located downstream of a combustor of the engine 10. Thus, it is desirable to provide cooling to the airfoils of the engine.

In order to provide cooling air to the vane 24, a plurality of cooling openings or cavities 26 are formed within an airfoil 28 of the vane 24. The cooling openings or cavities 26 are in fluid communication with a source of cooling air so that thermal loads upon the vane can be reduced. In one non-limiting example, the cooling air is provided from a compressor section of the gas turbine engine.

The airfoil 28 extends axially between a leading edge 25 and a trailing edge 27 and radially between platforms 29 and 31. The internal cooling passages 26 are defined along internal surfaces 36 of the airfoil section 28, as seen at least in FIGS. 3-8.

In the illustrated embodiment of FIG. 1, airfoil 28 is a stationary turbine vane for use in a turbojet or turbofan engine. In this embodiment, airfoil 28 is typically attached to a turbine case or flow duct at platform 29 and platform 31, using mechanical coupling structures such as hooks or by forming platforms 29, 31 as part of a case or shroud assembly.

In other embodiments, airfoil 28 may be configured for use in an industrial gas turbine engine, and platforms 29, 31 are modified accordingly. Alternatively, airfoil 28 may be formed as a rotating blade, for example blade 14 illustrated in FIG. 1. In these embodiments, airfoil or airfoil section 28 is typically formed into a tip at platform 31, and inner platform 29 accommodates a root structure or other means of attachment to a rotating shaft. In further embodiments, airfoil 28 is provided with additional structures for improved working fluid flow control, including, but not limited to, platform seals, knife edge seals, tip caps and squealer tips.

Airfoil 28 is exposed to a generally axial flow of combustion gas F, which flows across airfoil section 28 from leading edge 25 to trailing edge 27. Flow F has a radially inner flow margin at inner platform 29 and a radially outer flow margin at outer platform 31, or, in blade embodiments, at the blade tip.

To protect airfoil 28 from wear and tear due to the working fluid flow, its various components may be manufactured from durable, heat-resistant materials such as high-temperature alloys and superalloys. Surfaces that are directly exposed to hot gas may also be coated with a protective coating such as a ceramic thermal barrier coating (TBC), an aluminide coating, a metal oxide coating, a metal alloy coating, a superalloy coating, or a combination thereof.

Airfoil 28 is manufactured with internal cooling passages 26. The cooling passages are defined along internal surfaces forming channels or conduits for cooling fluid flow through airfoil section 28. In turbofan embodiments, the cooling fluid is usually provided from a compressed air source such as compressor bleed air. In ground-based industrial gas turbine embodiments, other fluids may also be used.

Figure 3:
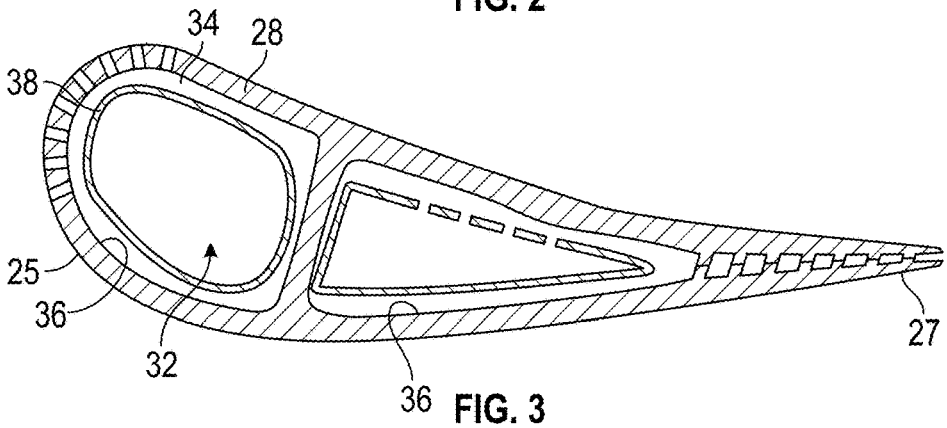
FIG. 3 is a cross-sectional view of a vane along lines A-A of FIG. 2.

In FIG. 3, the cooling openings or cavities 26 of one design are illustrated. However, a large opening as illustrated in FIG. 3, such as cavity 26 without the presence of insert 32, may result in lower Mach numbers of the air travelling therethrough and thus lower overall heat transfer due to the flow of cooling air through the cavities. In various embodiments disclosed herein, convective flow may be described in terms of Mach number.

In one implementation, baffle inserts 32 are inserted into the openings or cavities 26 in order to create smaller air passages 34 between an inner wall or surface 36 of the airfoil and an exterior surface 38 of the baffle insert 32. This will increase the Mach numbers of the air flowing in the smaller air passages 34 and will increase the heat transfer achieved by the cooling air passing through passages 34. In various embodiments disclosed herein the baffle insert 32 will produce or create Mach acceleration in the convective flow, increasing the heat transfer coefficient by generating greater turbulence and other flow interactions in the region between an exterior surface 38 of the baffle insert 32 and the internal airfoil surface 36 of cavities or openings 26. For example, augmentors such as trip strips and ribs, may be formed on the exterior surface 38 of the baffle insert 32 and/or the interior surface 36 of the airfoil in order to increase turbulence and improve internal cooling. In addition, pedestals may extend from and/or between the exterior surface 38 of the baffle insert 32 and/or the interior surface 36 of the airfoil in order to increase air flow turbulence and improve internal cooling.

By increasing the heat transfer coefficient of the cooling air passing through passages 34, this enhances convective cooling within the airfoil and lowers operating temperatures, increasing service life of the airfoil. Baffle insert 32 also reduces the cooling flow required to achieve these benefits, improving cooling efficiency and reserving capacity for additional downstream cooling loads.

Figure 4:
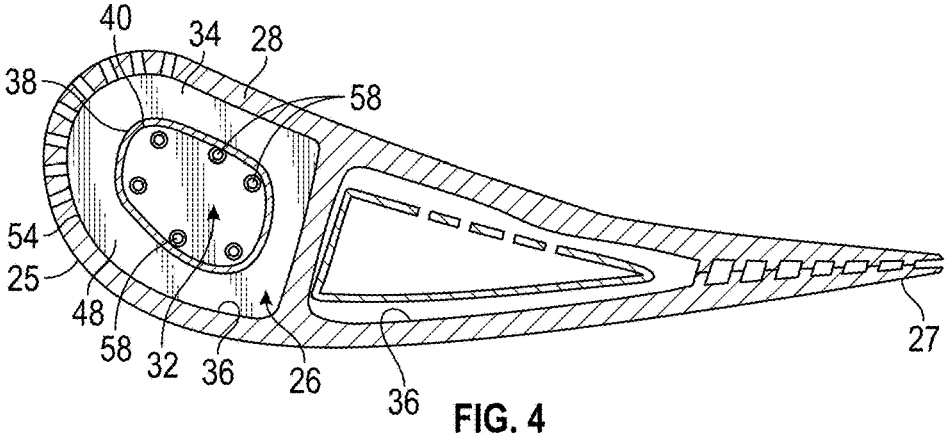
FIG. 4 is a cross-sectional view of a vane according to an embodiment of the present disclosure along lines A-A of FIG. 2.

Referring now to FIG. 4, an embodiment of the present disclosure is illustrated. Here, the airfoil 28 of vane 24 is configured to have a plurality of cooling openings or cavities 26, which may have any configuration. In addition, a corresponding baffle insert 32 is located in the cooling openings or cavities 26 in order to create smaller air passages 34 between an inner wall or interior surface 36 of the openings or cavities 26 of the airfoil 28 and the exterior surface 38 of the baffle insert 32. The baffle insert 32 may also have any configuration as long as it can be received within opening or cavity 26. This will increase the Mach numbers of the air flowing in the smaller air passages 34 and will increase the heat transfer achieved by the cooling air passing through passages 34. In this embodiment, the smaller air passages 34 may completely surround the baffle insert 32.

Although, FIG. 4 describes an airfoil 28 of a vane 24 it is understood that various embodiments of the present disclosure may be used in other applications or components of the engine 10 such as airfoils of a rotating blade, or an airfoil of a ground based turbine engine, or any component having an internal cavity wherein it is desirable to employ the baffle inserts 32 of the present disclosure in order to increase the heat transfer coefficient of the cooling air passing through the internal cavity in order to enhance convective cooling within the component and lower the operating temperatures of the component.

Figure 6:
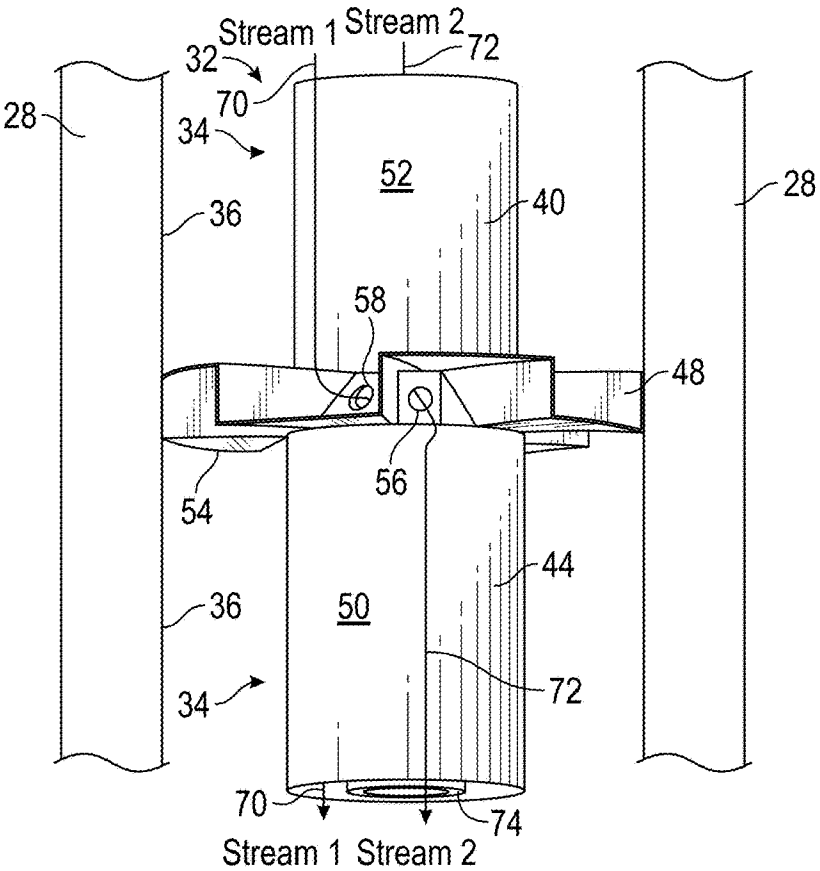
FIG. 6 is a view illustrating flow paths of a flow exchanging baffle insert according to an embodiment of the present disclosure.
Figure 5:
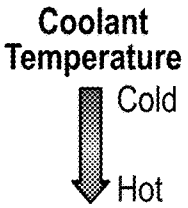
FIG. 5 is a cross-sectional view of a vane and a flow exchanging baffle insert according to an embodiment of the present disclosure.
Figure 5:
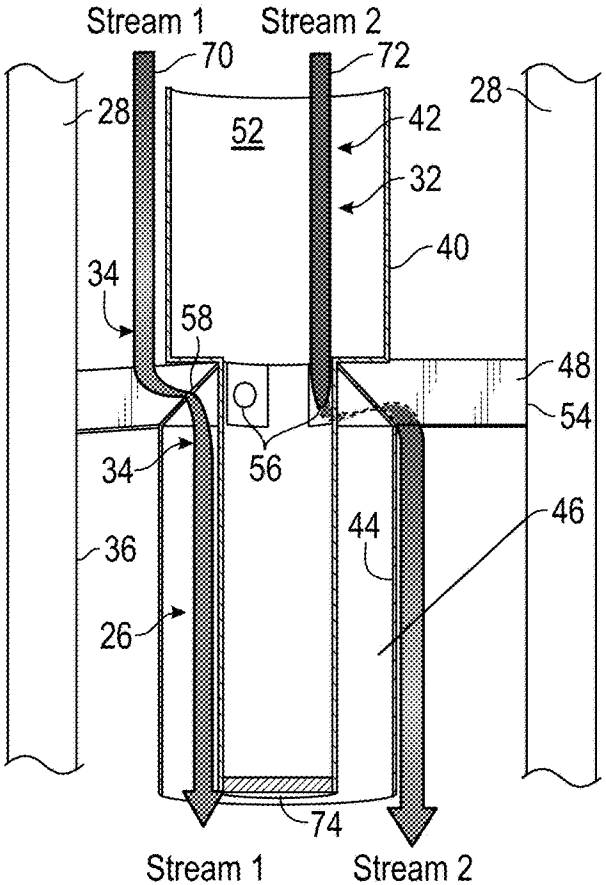
Figure 8:
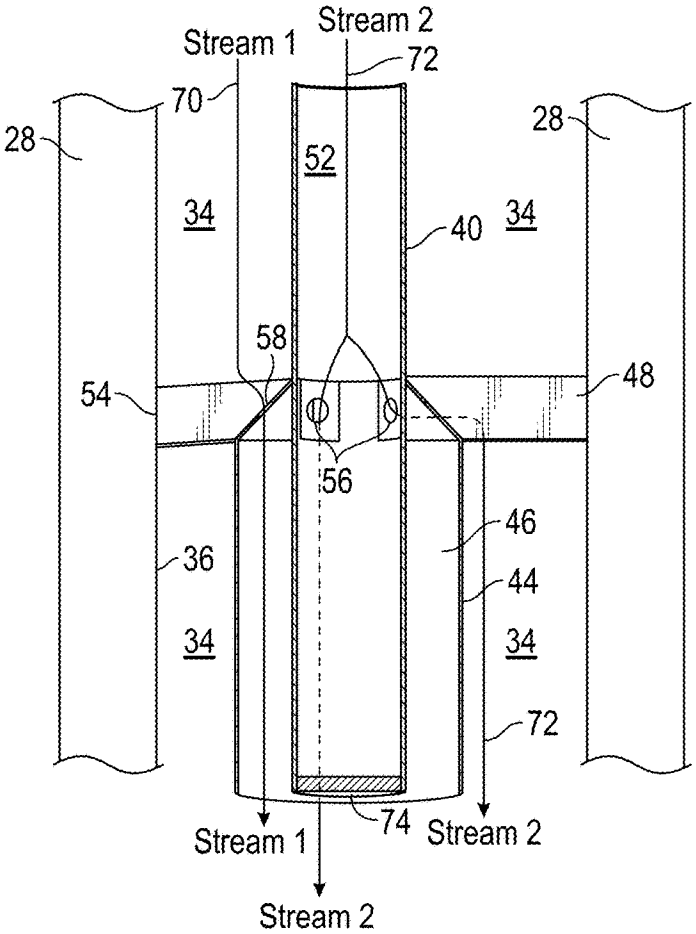
FIGS. 7 and 8 are views illustrating flow paths of a flow exchanging baffle insert according to an alternative embodiment of the present disclosure.
Figure 7:
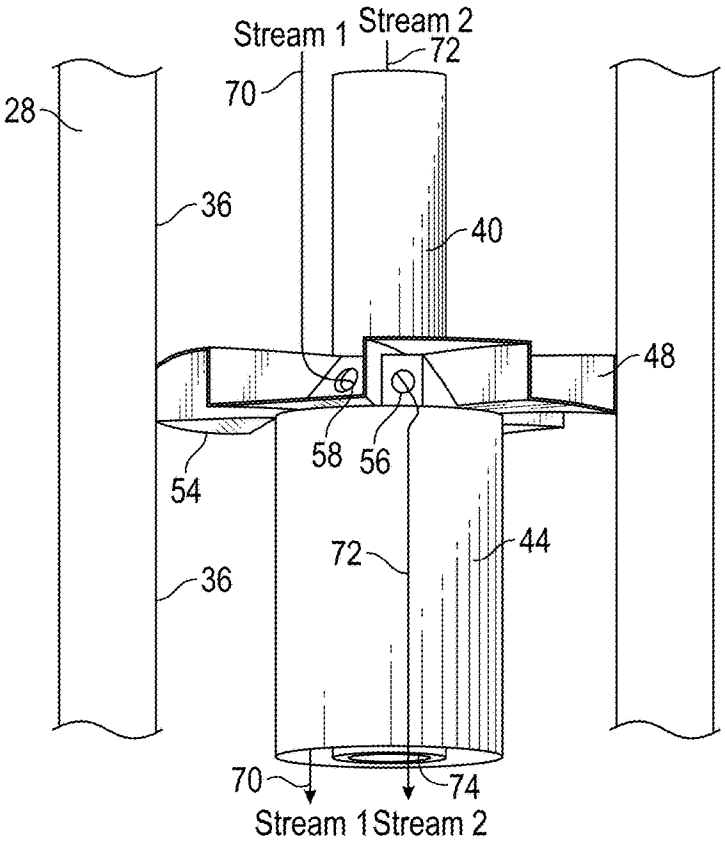
Figure 9:
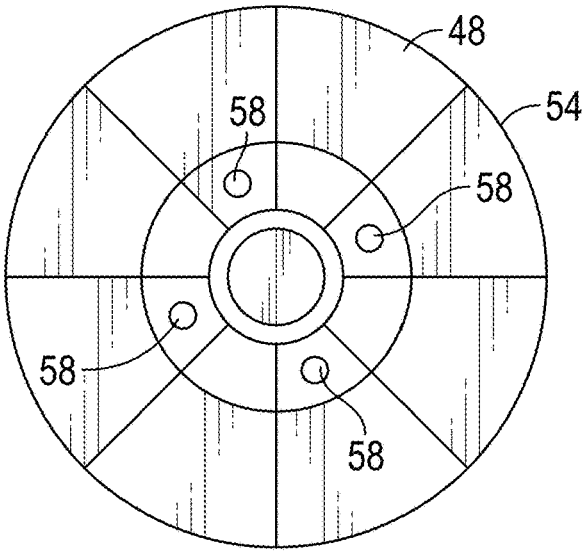
FIG. 9 is a top view of the flow exchanging baffle insert illustrated in FIGS. 7 and 8.
Figure 10:
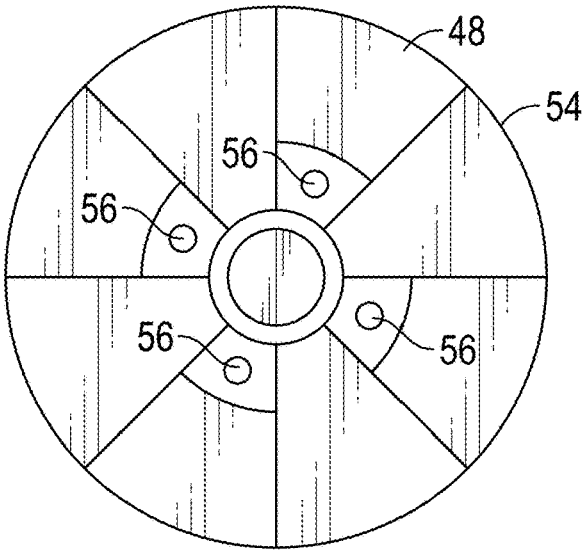
FIG. 10 is a bottom view of the flow exchanging baffle insert illustrated in FIGS. 7 and 8.

In accordance with various embodiments of the present disclosure and referring at least to FIGS. 4, 5 and 6, the baffle insert 32 is configured to have a first fluid conduit 40 having a first interior cavity 42 extending therethrough and a second fluid conduit 44 having a second interior cavity 46 extending therethrough. The first fluid conduit 40 and the second fluid conduit 44 may have any suitable configuration. The baffle insert 32 further comprises a member or sealing member 48 located between the first fluid conduit 40 and the second fluid conduit 44. The member or sealing member 48 may also have any suitable configuration. In accordance with one embodiment of the disclosure, the member 48 fluidly couples the first interior cavity 42 to an exterior 50 of the second fluid conduit 44. In addition, the member 48 is also configured to fluidly couple the second interior cavity 46 to an exterior 52 of the first fluid conduit 40.

In one embodiment and as at least illustrated in FIGS. 5 and 6, a peripheral portion 54 of the member 48 extends outwardly from the exterior 50 of the first fluid conduit 40 and from the exterior 52 of the second fluid conduit 44 until it contacts inner surface 36 of the cavity 26 such that the passage 34 surrounding the first interior cavity 42 is isolated from the passage 34 surrounding the second interior cavity 46 except for passages passing through the member 48. Accordingly, the first interior cavity 42 is in fluid communication with the smaller air passage 34 located between the internal surface 36 and the exterior 50 of the second fluid conduit 44 via at least one or a plurality of openings 56 extending through the member 48 and the second interior cavity 46 is in fluid communication with the smaller air passage 34 located between the internal surface 36 and the exterior 52 of the first fluid conduit 42 via at least one or a plurality of openings 58 and the member 48. In one non-limiting alternative embodiment, the periphery 54 of the member 48 may be slightly spaced from the inner surface 36 such that an alternative air passage or minor leakage passage between the periphery 54 of the member 48 and the inner surface 36 is provided. However, this alternative air passage should be configured so as to not interfere with or adversely affect the fluid flow between the first interior cavity 42 and the air passage 34 located between the internal surface 36 and the exterior 50 of the second fluid conduit 44 and the fluid flow between the second interior cavity 46 and the air passage 34 located between the internal surface 36 and the exterior 52 of the first fluid conduit 42.

As such and as disclosed herein, a pair of isolated airstreams are provided and illustrated by arrows 70, 72. This is particularly useful in the event if the cooling requirements of the component are high at the beginning of the channel (e.g., proximate to the first fluid conduit 42) as too much heat may be transferred into the coolant, and therefore heat cannot be removed from the end of the channel (e.g., proximate to the second fluid conduit 44) if no member 48 is employed. However, the member 48 allows an alternate source of cooling to be added to the passage 34 of the channel 26 from the interior 42 of the first fluid conduit 40 while the previously supplied coolant surrounding the exterior 52 of the first fluid conduit is redirected from the passage 34 of the channel into the interior 46 of the second fluid conduit 44. These two flow streams are illustrated by arrows 70 and 72 in the attached FIGS.

Accordingly, the first fluid conduit 40 acts as a shielded conduit or insulator allowing some air illustrated by arrow 72 to initially bypass the heat drawing internal walls of the airfoil 28 by locating it more centrally within baffle 32. This allows for a lower temperature coolant to be passed on to the heat drawing internal walls of the airfoil 28 after it has exited from the cavity 42 of the first fluid conduit 40 via the conduits 56 of the member 48. In turn, the previously heated air is transferred from the heat drawing walls to the internal cavity 46 of the second fluid conduit via openings 58 in the member 48.

The added cooling air transferred from the first cavity 42 can offset the additional heat picked by the air travelling along path 70 that might be a byproduct of the baffle's use (e.g., creation of smaller air passages 34). In addition, the baffle profile may be tailored to adjust the mass flux through the cooling circuit, which may allow for the effective management of heat transfer, heat pick-up and pressure loss in the cavity. In addition, and in one embodiment, the first fluid conduit 40 may have a plug 74 that seals a bottom of the first interior cavity 42 so that flow stream 72 is directed to an exterior 50 of the second fluid conduit 44. In addition and in one embodiment, the first fluid conduit 40 may be smaller than the second fluid conduit 44 and extend into the second interior cavity 46.

Referring now to FIGS. 7-10, an alternative embodiment of the present invention is illustrated. Here, the first fluid conduit 40 is configured to have a smaller dimension or diameter or configuration than that of the second fluid conduit 44 such that the passage 34 between the first fluid conduit 40 and an interior surface 36 of the airfoil 28 is greater than the passage 34 between the second fluid conduit 44 and an interior surface 36 of the airfoil 28. Alternatively, the second fluid conduit 44 is configured to have a smaller dimension or diameter or configuration than that of the first fluid conduit 40 such that the passage 34 between the second fluid conduit 44 and an interior surface 36 of the airfoil 28 is greater than the passage 34 between the first fluid conduit 40 and an interior surface 36 of the airfoil 28. In yet another embodiment, the diameter or dimensions or configurations of the first fluid conduit 40 and the second fluid conduit 44 may be the same. Moreover, the location of the member 48 may vary such that the corresponding lengths of the first fluid conduit 40 and the second fluid conduit 44 may vary with respect to each other or in one embodiment may be the same. Although specific configurations of the sealing member 48, fluid conduits 40 and 44, airfoil 28 and channel 26 are illustrated in the attached FIGS. it is, of course, understood that numerous configurations are contemplated and various embodiments of the present disclosure are not intended to be limited to the specific configurations illustrated in the FIGS. For example, the periphery 54 of the member 48 may have any configuration, which may be similar to or parallel with or mating with a corresponding internal periphery of the channel 26 proximate to the periphery 54.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A baffle insert for a component of a gas turbine engine, the baffle insert comprising:

a first fluid conduit having a first interior cavity extending therethrough;

a second fluid conduit having a second interior cavity extending therethrough; and a seal member located between the first fluid conduit and the second fluid conduit, wherein the seal member provides fluid communication between the first interior cavity and an exterior of the second fluid conduit through at least one a first opening, and wherein the seal member provides fluid communication between the second interior cavity and an exterior of the first fluid conduit through at least a second opening and wherein the seal member separates the first interior cavity from the second interior cavity.

2. The baffle insert as in claim 1, wherein the first fluid conduit is aligned with the second fluid conduit and the first fluid conduit is located above the second fluid conduit.

3. The baffle insert as in claim 1, wherein the seal member is configured to have a peripheral dimension that is greater than a peripheral dimension of the first fluid conduit and a peripheral dimension of the second fluid conduit.

4. The baffle insert as in claim 1, wherein the first fluid conduit has a first configuration and the second fluid conduit has a second configuration, wherein the first configuration is similar to the second configuration.

5. The baffle insert as in claim 4, wherein the seal member is configured to have a peripheral dimension that is greater than a peripheral dimension of the first fluid conduit and a peripheral dimension of the second fluid conduit.

6. The baffle insert as in claim 1, wherein the first fluid conduit has a peripheral dimension that is less than a peripheral dimension of the second fluid conduit.

7. The baffle insert as in claim 6, wherein the seal member is configured to have a peripheral dimension that is greater than a peripheral dimension of the first fluid conduit and a peripheral dimension of the second fluid conduit.

8. The baffle insert as in claim 7, wherein the first fluid conduit is aligned with the second fluid conduit and the first fluid conduit is located above the second fluid conduit.

9. A component for a gas turbine engine, the component comprising:

an internal cooling cavity extending through an interior of the component; and a baffle insert configured to be inserted into the internal cooling cavity, the baffle insert comprising: a first fluid conduit having a first interior cavity extending therethrough; a second fluid conduit having a second interior cavity extending therethrough; and a seal member located between the first fluid conduit and the second fluid conduit, wherein the seal provides fluid communication between the first interior cavity and an exterior of the second fluid conduit through at least one a first opening, and wherein the seal member provides fluid communication between the second interior cavity and an exterior of the first fluid conduit through at least a second opening and wherein the seal member separates the first interior cavity from the second interior cavity.

10. The component as in claim 9, wherein the first fluid conduit is aligned with the second fluid conduit and the first fluid conduit is located above the second fluid conduit.

11. The component as in claim 9, wherein the seal member is configured to have a peripheral dimension that is greater than a peripheral dimension of the first fluid conduit and a peripheral dimension of the second fluid conduit.

12. The component as in claim 9, wherein the first fluid conduit has a first configuration and the second fluid conduit has a second configuration, wherein the first configuration is similar to the second configuration.

13. The component as in claim 12, wherein the seal member is configured to have a peripheral dimension that is greater than a peripheral dimension of the first fluid conduit and a peripheral dimension of the second fluid conduit.

14. The component as in claim 9, wherein the first fluid conduit has a peripheral dimension that is less than a peripheral dimension of the second fluid conduit.

15. The component as in claim 14, wherein the seal member is configured to have a peripheral dimension that is greater than a peripheral dimension of the first fluid conduit and a peripheral dimension of the second fluid conduit.

16. The component as in claim 15, wherein the first fluid conduit is aligned with the second fluid conduit and the first fluid conduit is located above the second fluid conduit and wherein the seal member has a plurality of openings extending therethrough for fluidly coupling the first interior cavity to the exterior of the second fluid conduit, and fluidly coupling the second interior cavity to the exterior of the first fluid conduit.

17. The component as in claim 9, wherein the component is an airfoil of either a vane or a rotating blade of a gas turbine engine.

18. A method of exchanging a cooling flow through a component of a gas turbine engine, the method comprising:

directing a first flow of a cooling fluid through a baffle insert located in an internal cooling cavity extending through an interior of the component;

directing a second flow of the cooling fluid through the baffle insert, wherein the first flow of the cooling fluid passes through a first fluid conduit having a first interior cavity extending therethrough and the second flow of the cooling fluid passes through a second fluid conduit having a second interior cavity extending therethrough, wherein the first flow of cooling fluid is surrounded by the second flow of cooling fluid when the first flow of cooling fluid is located in the first interior cavity such that the first flow of cooling fluid is thermally insulated by the second flow of cooling fluid; and exchanging the locations of the first flow of the cooling fluid with respect to the second flow of the cooling fluid by passing the first flow of the cooling fluid and the second flow of the cooling fluid through a seal member located between the first fluid conduit and the second fluid conduit, wherein the seal member provides fluid communication between the first interior cavity and an exterior of the second fluid conduit through at least one a first opening, and wherein the seal member provides fluid communication between the second interior cavity and an exterior of the first fluid conduit through at least a second opening and wherein the seal member separates the first interior cavity from the second interior cavity and wherein the second flow of cooling fluid is surrounded by the first flow of cooling fluid when the second flow of cooling fluid is located in the second interior cavity such that the second flow of cooling fluid is thermally insulated by the first flow of cooling fluid.

19. The method as in claim 18, wherein the first fluid conduit is aligned with the second fluid conduit and is located above the second fluid conduit.

20. The method as in claim 18, wherein the component is an airfoil of either a vane or a rotating blade of a gas turbine engine.

* * * * *